US011052300B1

(12) United States Patent
Shie

(10) Patent No.: US 11,052,300 B1
(45) Date of Patent: Jul. 6, 2021

(54) FLYING DISC LAUNCHER

(71) Applicant: Cheng-Yi Shie, Tainan (TW)

(72) Inventor: Cheng-Yi Shie, Tainan (TW)

( * ) Notice: Subject to any disclaimer, the term of this patent is extended or adjusted under 35 U.S.C. 154(b) by 0 days.

(21) Appl. No.: 17/022,257

(22) Filed: Sep. 16, 2020

(51) Int. Cl.
*F41B 4/00* (2006.01)
*F41J 9/18* (2006.01)
*A63B 69/40* (2006.01)

(52) U.S. Cl.
CPC ..... *A63B 69/406* (2013.01)

(58) Field of Classification Search
CPC ..... A63B 69/40; A63B 69/406; F41B 4/00; F41J 9/18
USPC ..... 124/6, 78, 81; 473/422
See application file for complete search history.

(56) References Cited

U.S. PATENT DOCUMENTS 1,552,191 A * 9/1925 Bahlmann ..... F41J 9/30 124/26
1,638,283 A * 8/1927 Bahlmann ..... F41J 9/30 124/26
3,761,085 A * 9/1973 Cook ..... A63B 69/406 473/436
3,822,688 A * 7/1974 Mayne ..... A63B 69/40 124/6
4,220,130 A * 9/1980 Glover ..... A63B 69/408 124/36
5,050,575 A * 9/1991 Killion ..... F41B 7/08 124/8
5,396,876 A * 3/1995 Liscio ..... A63B 69/0024 124/34
5,611,322 A * 3/1997 Matsuzaki ..... F41B 4/00 124/6
5,720,664 A * 2/1998 Brubacher ..... F41A 33/02 124/8
5,782,228 A * 7/1998 Wu ..... F41B 4/00 124/6
5,947,101 A * 9/1999 Kerr ..... F41B 4/00 124/78
6,093,117 A * 7/2000 Sherlock ..... A63B 69/406 124/78
7,448,370 B2 * 11/2008 Lu ..... A63B 69/406 124/6
8,707,942 B2 * 4/2014 Lu ..... A63B 69/406 124/78
8,899,216 B2 * 12/2014 Laporte ..... F41J 9/24 124/6
9,052,169 B2 * 6/2015 Laporte ..... F41J 9/24
9,057,589 B2 * 6/2015 Laporte ..... F41J 9/18
9,086,257 B2 * 7/2015 Laporte ..... A63B 69/40
(Continued)

*Primary Examiner* — Alexander R Niconovich
(74) *Attorney, Agent, or Firm* — Karin L. Williams; Alan D. Kamrath; Mayer & Williams PC

(57) ABSTRACT

A flying disc launcher includes a frame body including a loading seat and a side wall. The loading seat includes a carrying portion and a receiving portion. A flying disc inlet and a flying disc outlet are respectively defined in both ends of the carrying portion. The side wall includes a guiding wall opposed to the receiving portion. A turntable is installed in the receiving portion and protrudes from an upper surface of the carrying portion. The power component is connected with the turntable to drive the turntable to rotate. When the turntable rotates and a flying disc is placed on the carrying portion from the flying disc inlet, the guiding wall and the turntable can contact the flying disc to drive and guide the flying disc to fly out toward the flying disc outlet.

9 Claims, 8 Drawing Sheets

(56) References Cited

U.S. PATENT DOCUMENTS

| | | | | |
|---|---|---|---|---|
| 9,163,913 | B2 * | 10/2015 | Laporte | F41J 9/18 |
| 9,914,041 | B2 * | 3/2018 | Vorozilchak | A63B 69/406 |
| 2006/0135290 | A1 * | 6/2006 | Lin | A63B 69/406<br>473/451 |

* cited by examiner

FLYING DISC LAUNCHER

BACKGROUND OF THE INVENTION

1. Field of the Invention

The present invention relates to a flying disc launcher and, more particularly, to an electric frisbee launching device.

2. Description of the Related Art

The conventional flying disc ejector (hand-held frisbee ejector) mostly uses the user's personal strength to squeeze the loaded flying disc to make it fly out. However, the implementation of the user holding the flying disc ejector by hand and making the flying disc fly out with personal strength not only makes the user feel tired or causes sports injuries, but also has the disadvantages of low flying height and short flying distance.

BRIEF SUMMARY OF THE INVENTION

Thus, an objective of the present invention is to provide a flying disc launcher which utilizes the rotation of a turntable to launch a flying disc instead of manpower to throw a flying disc. It is more convenient to use and can reduce unnecessary sports injuries. Furthermore, the flying disc launcher of the present invention is conveniently control the flying height, flying distance and direction of the flying disc to achieve the enhancement of the use efficiency.

To achieve this and other objectives, a flying disc launcher of the present invention includes a frame body, a turntable, and a power component. The frame body includes a loading seat and a side wall arranged along a periphery of the loading seat. The loading seat includes a carrying portion for a flying disc and a receiving portion adjacent to the carrying portion. A flying disc inlet and a flying disc outlet are respectively defined in both ends of the carrying portion. The side wall includes a guiding wall surrounding a side of the periphery of the loading seat adjacent to the carrying portion and opposed to the receiving portion. The carrying portion is located between the guiding wall and the receiving portion. The turntable is installed in the receiving portion and protrudes from an upper surface of the carrying portion. The power component is connected with the turntable to drive the turntable to rotate. When the turntable rotates and the flying disc is placed on the carrying portion from the flying disc inlet, the guiding wall and the turntable can contact the flying disc to drive and guide the flying disc to fly out of the flying disc outlet.

In an embodiment, the flying disc outlet has a concave arc surface.

In an embodiment, an adjusting knob is provided on the frame body to adjust a rotation speed of the power component.

In an embodiment, the flying disc launcher further includes a plurality of leg rods. Each leg rod is supported on a bottom of the loading seat and includes an inner tube and an outer tube. The inner tube and the outer tube can be relatively telescopic and positioned in a height direction, so that a height of each leg rod is adjustable.

In an embodiment, the outer tube is provided with a plurality of positioning holes, and the inner tube is provided with a perforation and a positioning member. The positioning member includes an elastic arm and a positioning buckle combined with one end of the elastic arm, with the elastic arm abutting against an inner wall of the inner tube and biasing the positioning buckle so that the positioning buckle passes through the perforation and is buckled in a corresponding positioning hole of the outer tube. When the positioning buckle is pressed to move toward an inside of the inner tube, the positioning buckle is separated from the corresponding positioning hole of the outer tube to release combination of the inner tube with the outer tube.

In an embodiment, the bottom of the loading seat is provided with a plurality of connecting tubes. Each leg rod is installed on the bottom of the loading seat through a corresponding connecting tube and is detachable with respect to the frame body. The bottom of the loading seat is further provided with two spaced receiving components for storing the plurality of leg rods.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 6:
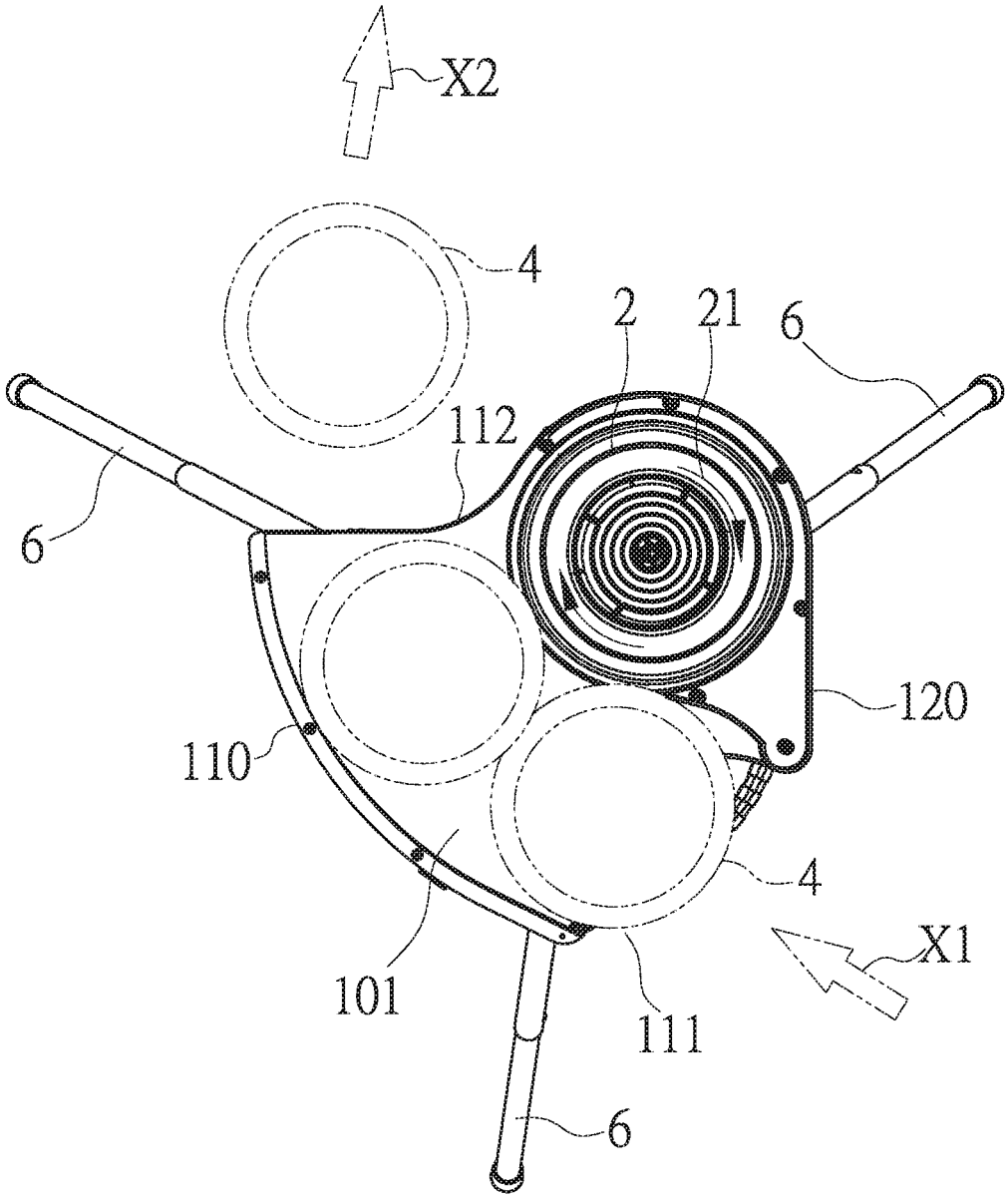
FIG. 6 is an operation schematic view of the flying disc launcher of FIG. 1.

A flying disc launcher according to an embodiment of the present invention is shown in FIGS. 1 through 5 of the drawings and includes a frame body 1, a turntable 2 and a power component 3. The frame body 1 includes a loading seat 10 and a side wall 11 perpendicular to the loading seat 10. The side wall 11 is arranged along the periphery of the loading seat 10. The loading seat 10 includes a carrying portion 101 and a receiving portion 102 adjacent to the carrying portion 101. The carrying portion 101 provides the placement of a flying disc 4 (FIG. 6). In this embodiment, the carrying portion 101 is flat, and the receiving portion 102 is recessed from an upper surface 103 of the carrying portion 101 to accommodate the turntable 2. A flying disc inlet 111 and a flying disc outlet 112 are respectively defined in both ends of the carrying portion 101. A concave arc surface 113 is formed at the flying disc outlet 112 and can reduce the friction generated between the driven flying disc 4 and the carrying portion 101, so that the flying disc 4 ejected from the flying disc outlet 112 can fly farther. The side wall 11 includes an arc-shaped guiding wall 110 surrounding a first side of the periphery of the loading seat 10 adjacent to the carrying portion 101 and a protecting wall 120 surrounding a second side of the periphery of the loading seat 10 adjacent to the receiving portion 102. The guiding wall 110 is opposed to the receiving portion 102, and the carrying portion 101 is located between the guiding wall 110 and the receiving portion 102.

In this embodiment, a cover 5 is engaged on the upper end of the side wall 11 to cover the loading seat 10. The cover 5 and the protecting wall 120 can prevent the user from accidentally touching the turntable 2 during usage. Furthermore, a handle 8 is provided on the frame body 1. In this embodiment, the handle 8 is provided on the periphery of the loading seat 10 and between the guiding wall 110 and the protecting wall 120. When the flying disc launcher is stored, the user can hold the handle 8 to carry the flying disc launcher. The user can also hold the handle 8 during use to stabilize the operation of the flying disc launcher.

Figure 1:
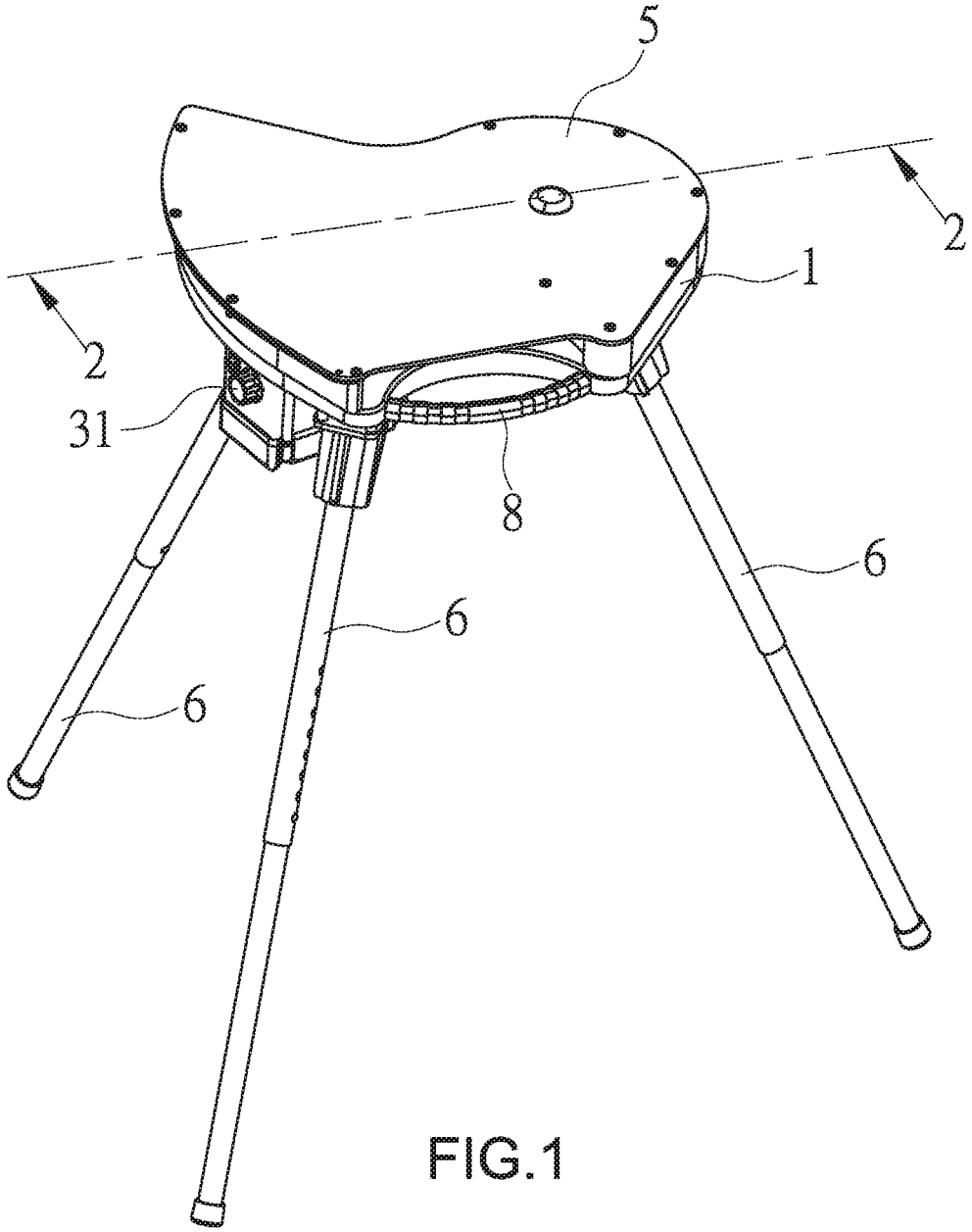
FIG. 1 shows a perspective view of a flying disc launcher according to an embodiment of the present invention.
Figure 2:
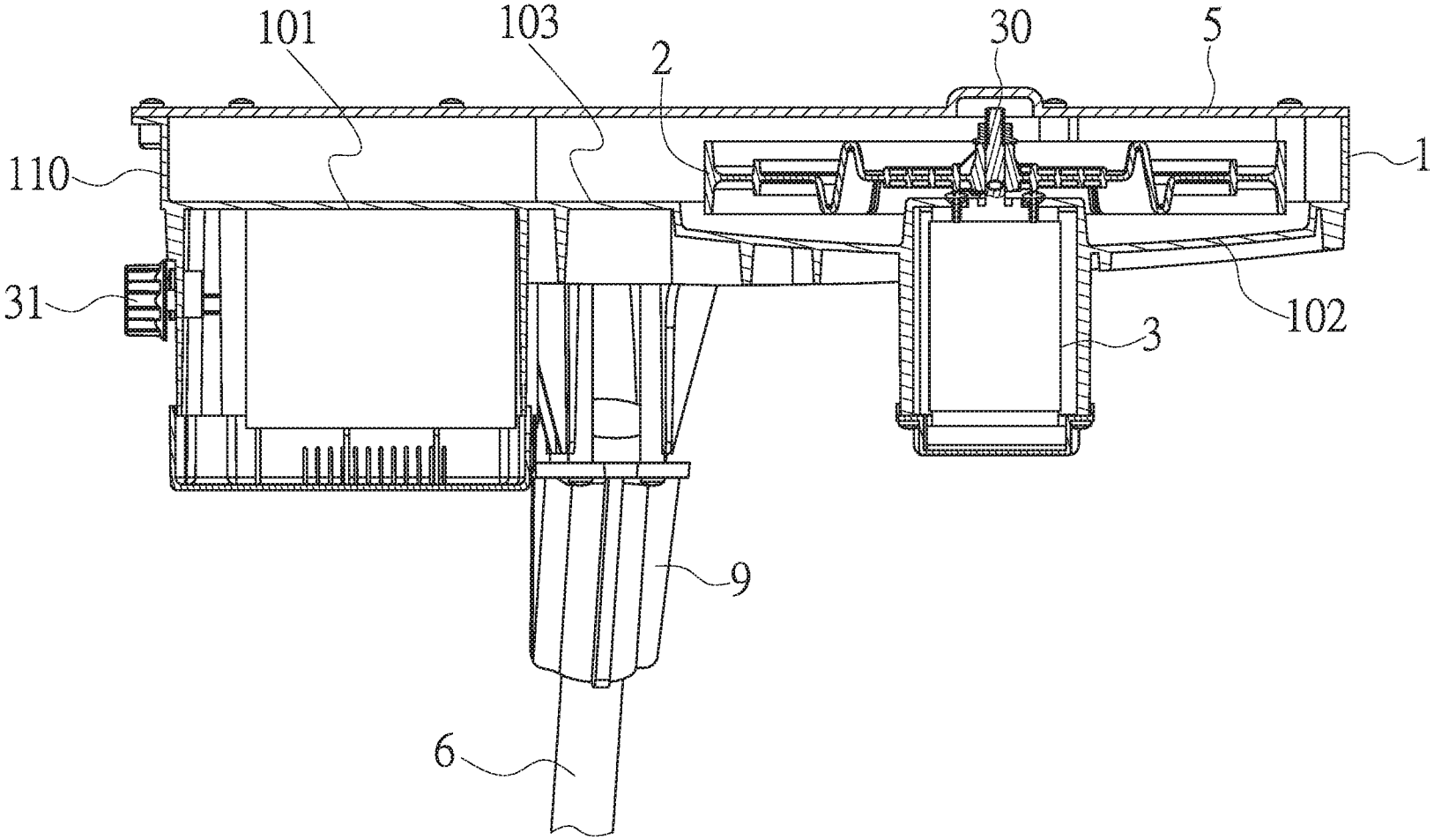
FIG. 2 is a cross-sectional view taken along line 2-2 of FIG. 1.

The turntable 2 is installed in the receiving portion 102 and protrudes from the upper surface 103 of the carrying portion 101 (FIG. 2). The distance between the guiding wall 110 and the turntable 2 is approximately equal to the diameter of the flying disc 4 (FIG. 6). Therefore, when the flying disc 4 is placed on the carrying portion 101 from the flying disc inlet 111, the guiding wall 110 and the edge of the turntable 2 can contact the flying disc 4 to drive and guide the flying disc 4 toward the flying disc outlet 112. In a feasible embodiment, the distance between the guiding wall 110 and the turntable 2 is adjustable.

Figure 3:
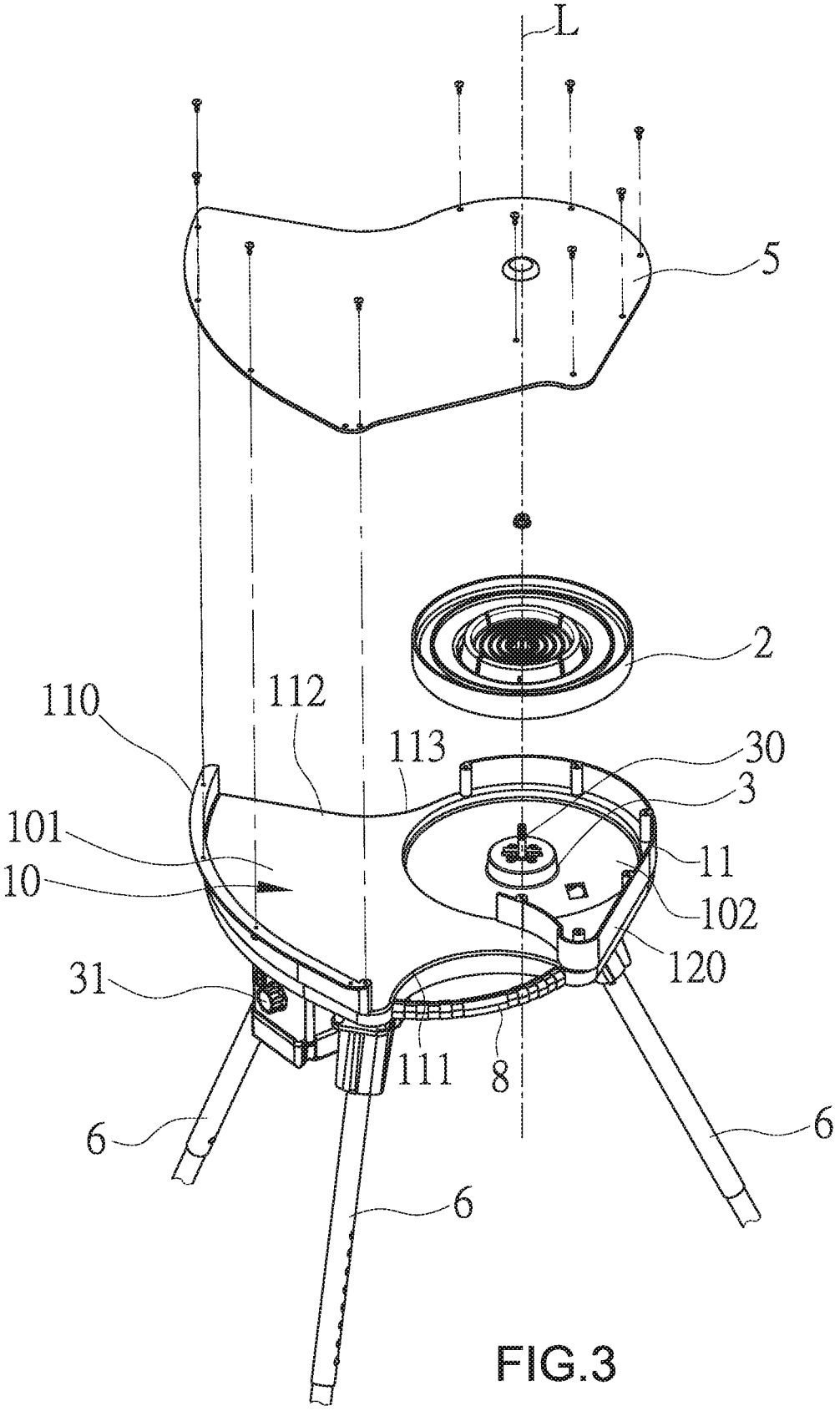
FIG. 3 shows an exploded view of the flying disc launcher of FIG. 1.
Figure 4:
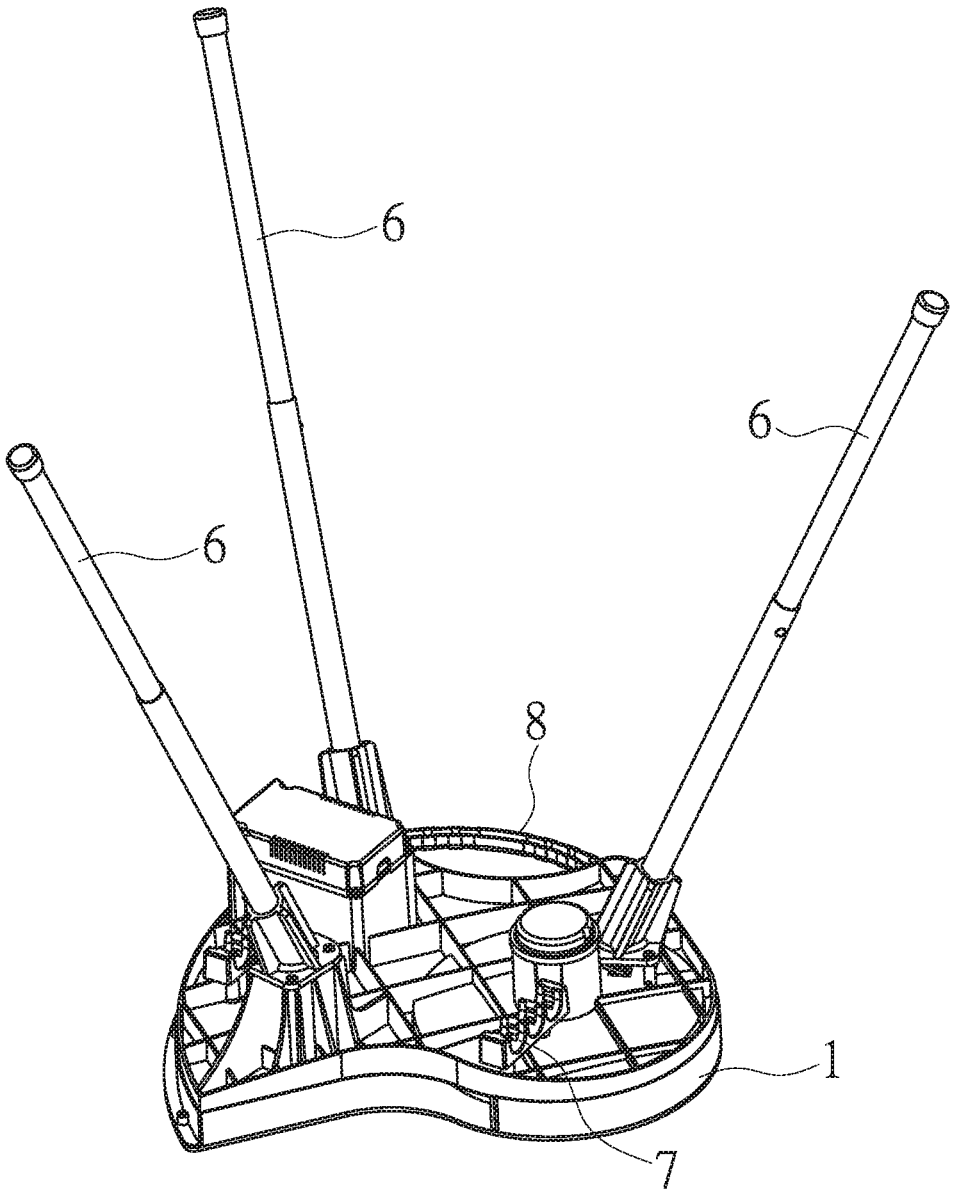
FIG. 4 shows another perspective view of the flying disc launcher of FIG. 1.
Figure 5:
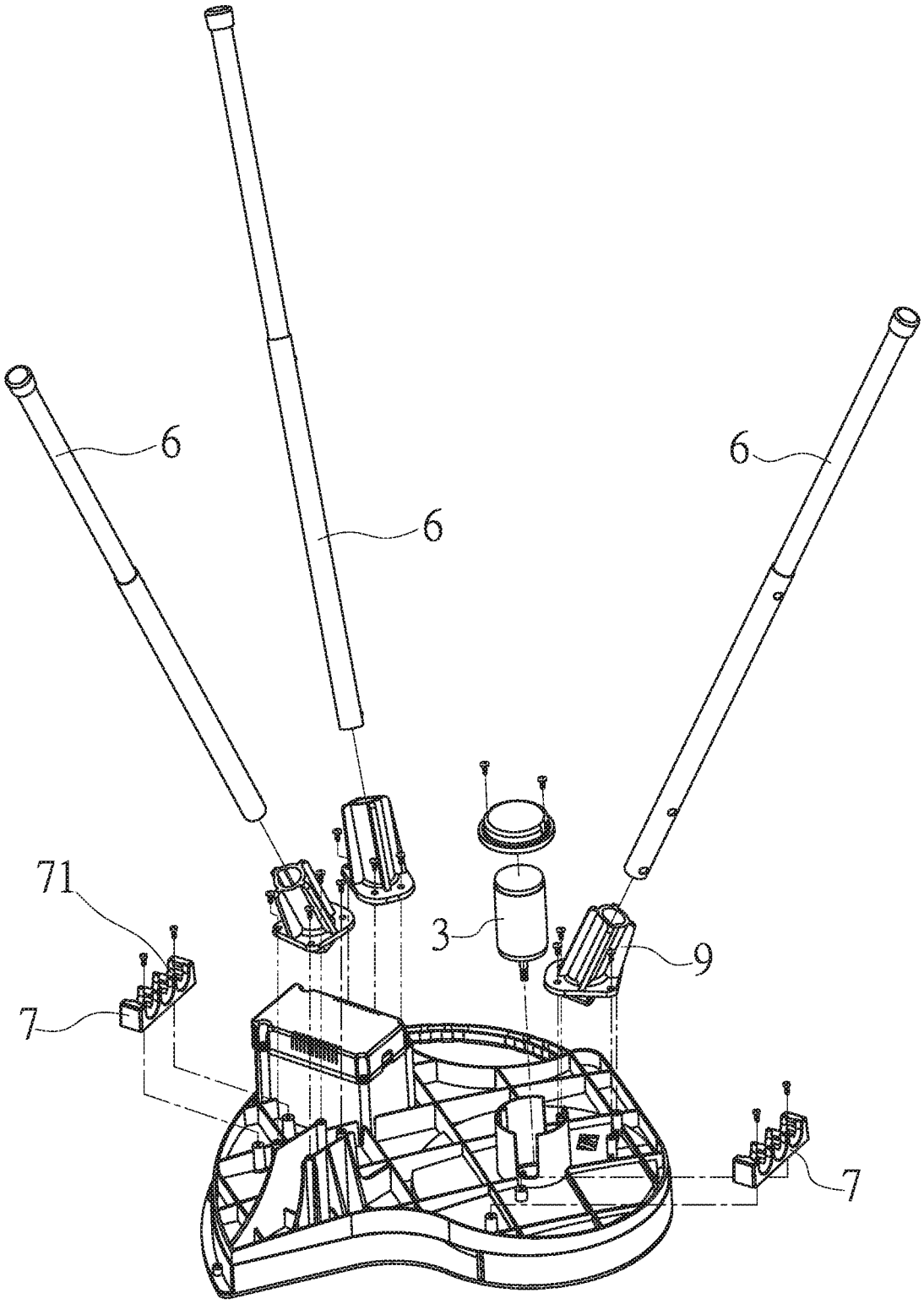
FIG. 5 shows another exploded view of the flying disc launcher of FIG. 1.

The power component 3 is installed on a lower side of the receiving portion 102 and has a shaft 30 extending into the receiving portion 102. The shaft 30 is connected to the turntable 2 so that the turntable 2 can be driven by the power component 3 to rotate relative to a longitudinal axis L (FIG. 3). The direction of rotation of the turntable 2 is shown by the arrow 21 in FIG. 6. In one embodiment, the power component 3 is a motor, and an adjusting knob 31 is provided on the frame body 1 to adjust the rotation speed of the motor, thereby controlling the flying distance of the flying disc 4. When the adjusting knob 31 adjusts the motor speed to zero, the power supply connected to the motor can be turned off. In a feasible embodiment, a switch can be provided on the frame body 1 to turn on or off the power of the power component 3 (not shown in the drawings).

With reference to FIG. 6, the flying disc 4 is placed on the carrying portion 101 (located in the space defined by the guiding wall 110, the turntable 2 and the carrying portion 101) from the flying disc inlet 111 in the X1 direction. When the turntable 2 is driven by the power component 3, the periphery of the turntable 2 will be in contact with the flying disc 4 to provide the driving force for the flying disc 4 to move forward, and the guiding wall 110 can guide the flying disc 4 to move in a predetermined direction, so that the flying disc 4 can fly out of the flying disc exit 112 in the direction of X2.

Figure 8:
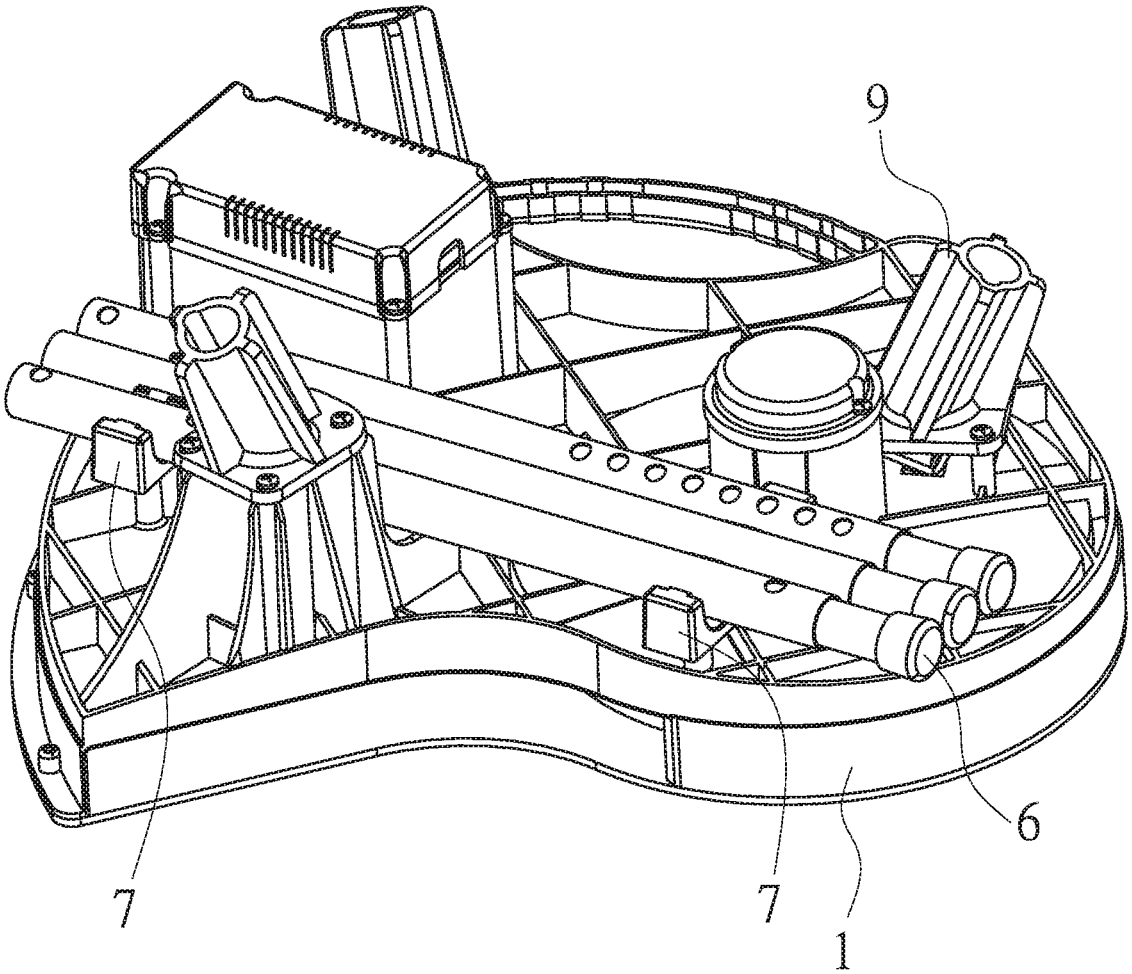
FIG. 8 is a schematic diagram showing the folding of a tripod of the flying disc launcher of FIG. 4.

The flying disc launcher further includes a tripod. The tripod includes a plurality of leg rods 6 and is supported on the bottom of the frame body 1. In this embodiment, the tripod includes three leg rods 6, and three connecting tubes 9 are arranged at the bottom of the loading seat 10. Each leg rod 6 is installed on the bottom of the loading seat 10 through a corresponding connecting tube 9 and can be detached relative to the frame body 1. Furthermore, the bottom of the loading seat 10 is further provided with two spaced receiving components 7 for storing the tripod (FIG. 8). In this embodiment, the receiving component 7 is provided with a plurality of semi-annular snap slot 71 for the plurality of leg rods 6 to be combined.

Figure 7:
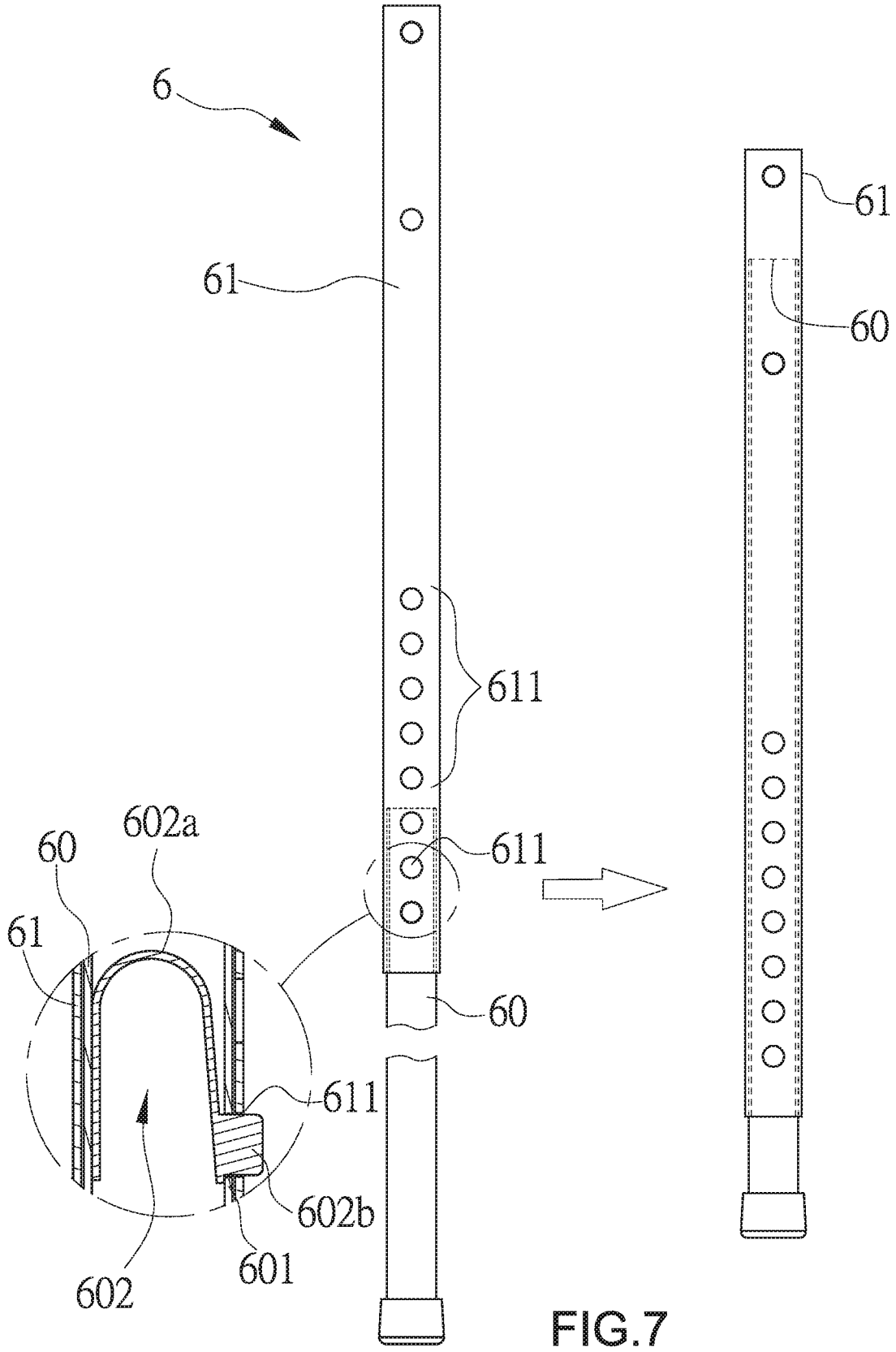
FIG. 7 shows a side view of a leg rod of the flying disc launcher of FIG. 1 and a schematic diagram of height adjustment of the leg rod.

With reference to FIG. 7, each leg rod 6 includes an inner tube 60 and an outer tube 61. The inner tube 60 and the outer tube 61 can be relatively telescopic and positioned in a height direction, so that the height (length) of each leg rod 6 is adjustable. The outer tube 61 is provided with a plurality of positioning holes 611, and the inner tube 60 is provided with a perforation 601 and a positioning member 602. The positioning member 602 includes an elastic arm 602*a* and a positioning buckle 602*b*. The elastic arm 602*a* is generally U-shaped and abuts against the inner wall of the inner tube 60, and the positioning buckle 602*b* is coupled to one end of the elastic arm 602*a* (please refer to the partial enlarged view in FIG. 7). The elastic arm 602*a* can apply an outward bias to the positioning buckle 602*b*, so that the positioning buckle 602*b* passes through the perforation 601 and is buckled into one of the positioning holes 611 of the outer tube 61 to combine the inner tube 60 with the outer tube 61. When the user wants to adjust the height (length) of the leg rod 6, he can press the positioning buckle 602*b* to move toward the inner tube 60 so that the positioning buckle 602*b* is separated from the positioning hole 611 in the outer tube 61 to release the combination of the inner tube 60 with the outer tube 61. Then, after moving the outer tube 61 to the required height, the positioning buckle 602*b* will be snapped with a selected positioning hole 611, so that the inner tube 60 and the outer tube 61 are combined together. In use, when the height of one or two of the plurality of leg rods 6 is adjusted, the inclination angle of the loading seat 10 is changed, so that the projection angle of the flying disc can be adjusted.

The scope of the invention is to be indicated by the appended claims, rather than by the foregoing description, and all changes which come within the meaning and range of equivalency of the claims are intended to be embraced therein.

The invention claimed is:

1. A flying disc launcher comprising:

a frame body including a loading seat and a side wall arranged along a periphery of the loading seat, with the loading seat including a carrying portion for a flying disc and a receiving portion adjacent to the carrying portion, wherein an upper surface of the carrying portion is flat and wherein the receiving portion is recessed from the upper surface of the carrying portion, and with a flying disc inlet and a flying disc outlet respectively defined in both ends of the carrying portion, with the side wall including a guiding wall surrounding a side of the periphery of the loading seat adjacent to the carrying portion and opposed to the receiving portion, with the carrying portion located between the guiding wall and the receiving portion;

a circular turntable installed in the recessed receiving portion and an upper portion of the circular turntable protruding from the upper surface of the carrying portion; and a power component connected with the turntable to drive the turntable to rotate;

wherein when the circular turntable rotates and the flying disc is placed on the carrying portion from the flying disc inlet, the guiding wall and the circular turntable can contact the flying disc to drive and guide the flying disc to fly out of the flying disc outlet.

2. The flying disc launcher according to claim 1, wherein the flying disc outlet has a concave arc surface.

3. The flying disc launcher according to claim 1, wherein an adjusting knob is provided on the frame body to adjust a rotation speed of the power component.

4. The flying disc launcher according to claim 1, wherein a distance between the guiding wall and the turntable is approximately equal to a diameter of the flying disc.

5. The flying disc launcher according to claim 1, further comprising:

a plurality of leg rods, with each leg rod supported on a bottom of the loading seat and including an inner tube and an outer tube, wherein the inner tube and the outer tube can be relatively telescopic and positioned in a height direction, so that a height of each leg rod is adjustable.

6. The flying disc launcher according to claim 5, wherein the outer tube is provided with a plurality of positioning holes, and the inner tube is provided with a perforation and a positioning member, with the positioning member including an elastic arm and a positioning buckle combined with one end of the elastic arm, with the elastic arm abutting against an inner wall of the inner tube and biasing the positioning buckle so that the positioning buckle passes through the perforation and is buckled in a corresponding positioning hole of the outer tube, wherein when the positioning buckle is pressed to move toward an inside of the inner tube, the positioning buckle is separated from the corresponding positioning hole of the outer tube to release combination of the inner tube with the outer tube.

7. The flying disc launcher according to claim 6, wherein the bottom of the loading seat is provided with a plurality of connecting tubes, with each leg rod installed on the bottom of the loading seat through a corresponding connecting tube and being detachable with respect to the frame body.

8. The flying disc launcher according to claim 7, wherein the bottom of the loading seat is further provided with two spaced receiving components for storing the plurality of leg rods.

9. The flying disc launcher according to claim 1, wherein a handle is provided on the frame body.

* * * * *